United States Patent [19]

Heier et al.

[11] 4,080,901

[45] Mar. 28, 1978

[54] MOLDED COMPOSITE PYROGEN IGNITER FOR ROCKET MOTORS

[75] Inventors: Wilbur C. Heier, Hampton; Melvin H. Lucy, Virginia Beach, both of Va.

[73] Assignee: The United States of America as represented by the Aministrator of the National Aeronautics and Space Administration, Washington, D.C.

[21] Appl. No.: 678,520

[22] Filed: Apr. 20, 1976

[51] Int. Cl.[2] ..... F42B 15/10

[52] U.S. Cl. ..... 102/49.7; 60/39.82 E; 102/39; 102/70 R; 285/192

[58] Field of Search ..... 102/70 R, 39, 70.2 A, 102/43 D, 49.7; 60/39.82 R, 39.82 E, 256; 220/288; 285/192, 220, 212; 403/195, 201, 238, 239

[56] References Cited

U.S. PATENT DOCUMENTS

| | | | |
|---|---|---|---|
| 2,462,135 | 2/1949 | Skinner | 102/70.2 A |
| 2,561,670 | 7/1951 | Miller et al. | 102/70.2 A X |
| 3,031,842 | 5/1962 | Ledwith | 62/234 |
| 3,129,561 | 4/1964 | Priapi | 60/39.82 E X |
| 3,151,447 | 10/1964 | Bornstein | 102/70 X |
| 3,190,372 | 6/1965 | Johnson | 102/49.7 X |
| 3,529,418 | 9/1970 | Puckett et al. | 60/256 X |
| 3,581,662 | 6/1971 | Grebert | 102/70.2 A |
| 3,780,151 | 12/1973 | Heier | 425/355 |
| 3,906,720 | 9/1975 | Boydston | 102/49.7 |

*Primary Examiner*—Harold Tudor
*Attorney, Agent, or Firm*—Wallace J. Nelson; Howard J. Osborn; John R. Manning

[57] ABSTRACT

A lightweight pyrogen igniter assembly including an elongated molded plastic tube adapted to contain a pyrogen charge and to be inserted into a rocket motor casing for ignition of the rocket motor charge with a molded plastic closure cap provided for the elongated tube and including an ignition charge within the cap for igniting the pyrogen charge and an electrically actuated ignition squib within the cap for igniting the ignition charge. The ignition charge is contained within a portion of the closure cap and it is retained therein by a noncorrosive ignition pellet retainer or screen which is adapted to rest on a shoulder of the elongated tube when the closure cap and tube are assembled together. The interior of the closure cap and the exterior of the elongated tube are provided with matching tapered spiral buttress threads to serve as the attachment means therefor. A circumferentially disposed metal ring is provided along the external circumference of the closure cap and is molded or captured within the plastic cap in the molding process to provide, along with O-ring seals, a leakproof rotary joint as part of the containing wall with the rocket motor casing when the igniter assembly is installed within the rocket motor casing.

12 Claims, 6 Drawing Figures

MOLDED COMPOSITE PYROGEN IGNITER FOR ROCKET MOTORS

ORIGIN OF THE INVENTION

The invention described herein was made by employees of the United States Government and may be manufactured and used by or for the Government for governmental purposes without the payment of any royalties thereon or therefor.

BACKGROUND OF THE INVENTION

This invention relates generally to rocket motor igniters and relates in particular to a molded plastics composite rocket motor pyrogen igniter assembly that may be produced on a production line basis and is readily adaptable for all present day existing and anticipated rocket motors that may be employed by the National Aeronautics and Space Administration for sounding rocket vehicles and in various military rocket motors as well as for anticipated space shuttle payload rocket launches and the like.

In the field of rocket motor ignition where solid propellant grains are utilized, it is the general practice to employ an igniter assembly that includes a pyrogen propellant material and an initiator for the pyrogen with the igniter assembly being, in some instances, formed of a two-piece system wherein the initiator charge is removable from the rocket motor while the pyrogen material is permanently installed and maintained within the combustion chamber adjacent the solid propellant rocket charge. Unitary or single piece non-standard igniter assemblies have been employed but these, as in the two-piece construction, must be individually machined and fabricated for each different rocket motor. This individual machining of the metallic parts employed in constructing the igniter increases the cost of the igniter assembly as well as provides unnecessary weight to the rocket motor. In propelling payloads, such for example in the anticipated space shuttle missions, and in various sounding rockets and other space applications, the additional weight utilized in the igniter serves to reduce the prospective payload weight that could be transported by the solid propellant rocket motor. The firm users identified to date would be the NASA Scout launch vehicle which employs solid rocket motors consisting of Algol III, Castor II-A, Antares, Altair III, and the proposed higher energy versions of each of these which are presently under study; the NASA Delta and Japanese N launch vehicles using solid motors consisting of the Castor II-A, and TE-364; the Air Force Block Five Launch Vehicle, and the Astrobee "F" sounding rocket vehicle. Other potential users include the second stage Minuteman, Terrier Malemute and the Navy HARM missiles. Other potential users of the concept are any of those who may employ solid propellant propulsion systems on space or military rocket motors. The invention also applies to any solid rocket motor design that utilizes a pryogen igniter that is presently known or anticipated.

Most conventional solid rocket motors now employed by NASA and the military utilize non-standard pyrogen igniters having a design that varies from motor to motor and which has changed little over the last 10 to 15 years. The pyrogen performs a common function which is to furnish a controlled, high temperature, high pressue, particle-laden gas to ignite the propellant surface in a solid rocket motor. In reality, the pyrogen igniter of the present invention is itself a miniature solid rocket motor that burns for short duration and consists of very few inert components and a pyrotechnic train. The inert components in presently used igniters of this type consist of numerous parts. The caps or rocket motor case closures are generally fabricated from steel, titanium, or aluminum held in place within the rocket motor casing by a steel snap-ring or machined threads and this cap must be heavily insulated to protect it during rocket motor burning. These known caps or closures contain provisions for initiators and pressure monitoring ports as well as O-ring seals. The pyrogen case or pressure vessel in presently used igniters usually consist of a steel, titanium, aluminum or fiberglass shell that is also heavily insulated inside and out to protect it when the pyrogen and the rocket motor are burning. The insulation material is generally a molded phenolic-/asbestos or rubber/asbestos compound. The hot gases exhausted from the pyrogen must pass through one or more nozzles at the end of the shell with the nozzles being generally made from molded phenolic/glass, asbestos or graphite material. A steel or titanium slotted plate or screen is usually included to retain the pyrotechnic ignition pellet charge within the igniter and the inside surface of the pyrogen case insulator generally receives a coating of a rubber liner material to insure good adhesion between the insulator and the solid propellant charge placed in the pyrogen tube.

These non-standard pyrogen igniters have proved sufficient for present day needs; however, they impose unnecessary penalties on the overall systems that use solid propellant rocket motors with pyrogen igniters. These present day pyrogen igniters contain numerous, complex, massive, relatively expensive, heavily insulated metal and non-metal parts that must be fabricated individually and that require many man hours for fabrication and assembly and meticulous inspection throughout for quality control. There is no common or universal design for the various igniters employed by different rocket motor manufacturers and each new design must be evaluated and qualified. Thus, proven reliability suffers because of the relatively few number of devices that are tested and used.

All molded pyrogen igniter designs of the present invention can be incorporated into their respective solid motors during normal operational use and this can be done as part of routine surveillance testing, product improvements, or new procurements or developments.

It is therefore an object of the present invention to provide a novel molded composite rocket motor pyrogen igniter assembly. It is a further object of the present invention to provide a molded composite rocket motor pyrogen igniter assembly that is light in weight and less expensive to construct than presently used igniter assemblies. It is another object of the present invention to provide a novel rocket motor igniter assembly having common geometry and materials that is useful as a standard igniter for numerous solid rocket motors.

BRIEF SUMMARY OF THE INVENTION

The foregoing and other objects, which will be apparent to those of ordinary skill in the art, are achieved according to the present invention by providing a molded elongated plastics tube adapted to contain a pyrogen charge and to be inserted into a rocket motor case for ignition of the rocket motor charge with the elongated tube having a closed end with one or more exit ports or nozzles therethrough and an open end on which is formed, during the molding process, spiral buttress threads. This elongated tube is closed by a molded plastics cap or cover having a circumferentially disposed metal ring molded and captured within the plastics body for securing the assembly within the rocket motor casing. The open end of the molded closure cap is provided with internal molded spiral buttress threads for securing the cap to the elongated tube. The interior of the cap contains the ignition charge with suitable ports therein communicating with an electrically actuated explosive initiator. In one embodiment of the present invention a safe-arm rotor is also contained within the closure cap and is movable from a safe position in which the path between the electrically actuated initiator and the ignition charge is interrupted to an armed position in which a port provided through the rotor provides communication between the electrically actuated initiator and the ignition charge.

Suitable O-ring seals are provided adjacent the captured metal ring on the closure cap to provide an airtight or leakproof closure with the rocket motor casing.

DETAILED DESCRIPTION

A more complete appreciation of the invention and many of the attendant advantages thereof will be readily apparent as the same becomes better understood by reference to the following detailed description when considered in connection with the accompanying drawings wherein.

Figure 1:
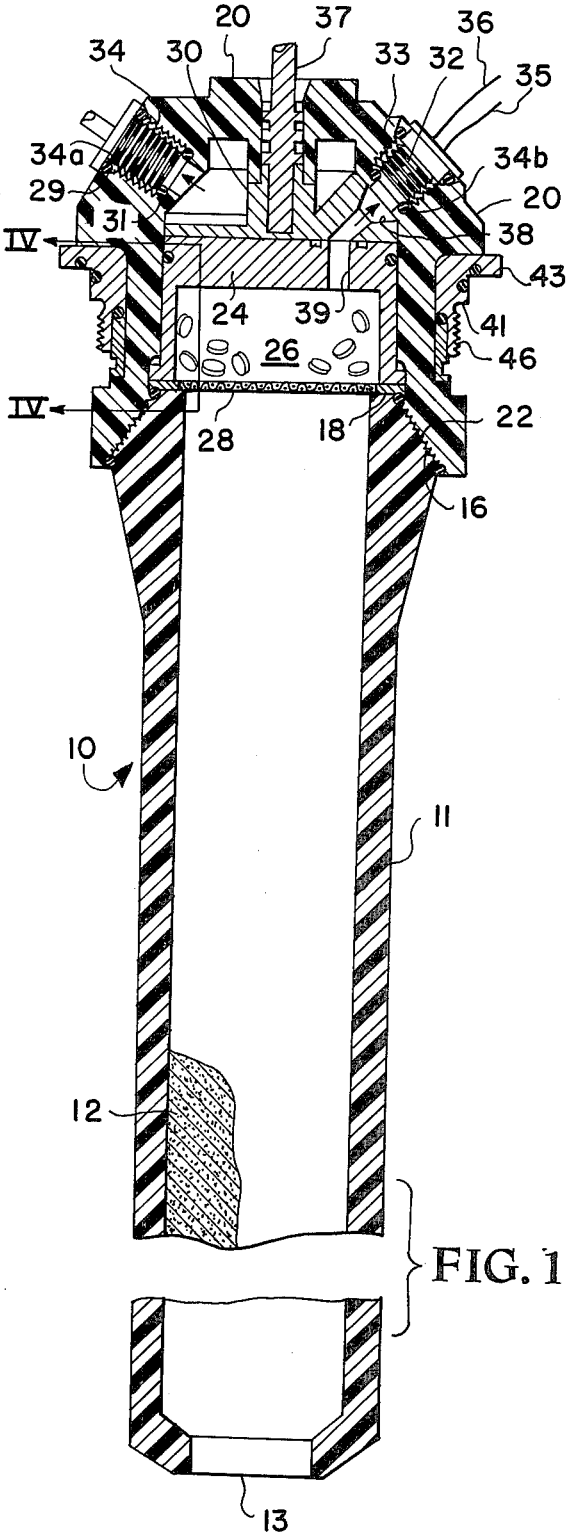
FIG. 1 is a part sectional view taken along line I—I of FIG. 6 and illustrating one embodiment of the lightweight molded plastics pyrogen igniter assembly according to the present invention.

Referring now more particularly to the drawings and more particularly to FIG. 1, there is shown one embodiment of the present lightweight, molded plastics pyrogen igniter assembly and designated generally be reference numeral 10.

Igniter assembly 10 includes an elongated molded plastics tube 11 having a nozzle exit or port 13 disposed at the closed end thereof for expelling hot ignition gases from the pyrogen charge 12 contained within elongated tube 11 when the igniter assembly 10 is ignited. The other end of elongated tube 11 is tapered outwardly along the exterior surface thereof to provide a relatively thicker cross-sectional area for tube 11 and then tapered inwardly along essentially the remaining length thereof with spiral buttress threads 16 formed on the exterior surface thereof and terminating slightly short of the end of tube 11 to provide a shoulder surface 18 at the end of tube 11. Elongated tube 11 is closed at the open threaded end thereof with a closure cap as designated by reference numeral 20.

Cap 20 is provided with internal spiral buttress threads 22 matching threads 16 on tube 11 for engagement of cap 20 to tube 11. An ignition pellet cup 24 is housed within closure cap 20 and contains an ignition charge 26 therein. Ignition pellet cup 24 is locked against relative rotation within closure cap 20 in a conventional manner. Ignition pellet charge 26 is retained within cup 24 by a noncorrosive ignition pellet retainer plate or screen 28. The ignition pellet retainer 28 is perforated so as to permit the passage of ignition gases from ignition charge 26 to the pyrogen charge 12 contained within tube 11 but with the perforations thereof being of sufficiently small size to prevent the passage of any of the ignition pellets from pellet charge 26 therethrough. Only a small number of the pellets are shown in the drawings in the interest of clarity.

A rotatable safe-arm rotor 30 is disposed within closure cap 20 adjacent ignition pellet cup 24. An electrically actuated ignition squib 32 is secured within squib fitting 33. Squib fitting 33 is a threaded stainless steel insert that is molded within closure cap 20. Suitable electrical lead wires 35 and 36 connect squib 32 to a suitable electrical circuit for ignition thereof in response to an electric signal in a conventional manner.

As shown in FIG. 1, the safe-arm rotor 30 is positioned in the armed position with bore 38 therein communicating with squib 32 and pellet charge 26 via passageway 39 formed within pellet cup 24.

When in the safe position, rotor 30 would be rotated 90°, in a conventional manner, about the axis of cylindrical extension 37 to interpose a solid portion of the rotor 30 between squib 32 and passageway 39 to thereby interrupt the communication between squib 32 and ignition charge 26. In this position, in the event squib 32 were accidentally discharged, the explosive gases therefrom would be harmlessly dissipated within the cavity formed within closure cap 20 and adjacent rotor 30 without any danger of igniting the ignition pellet charge 26.

Figure 6:
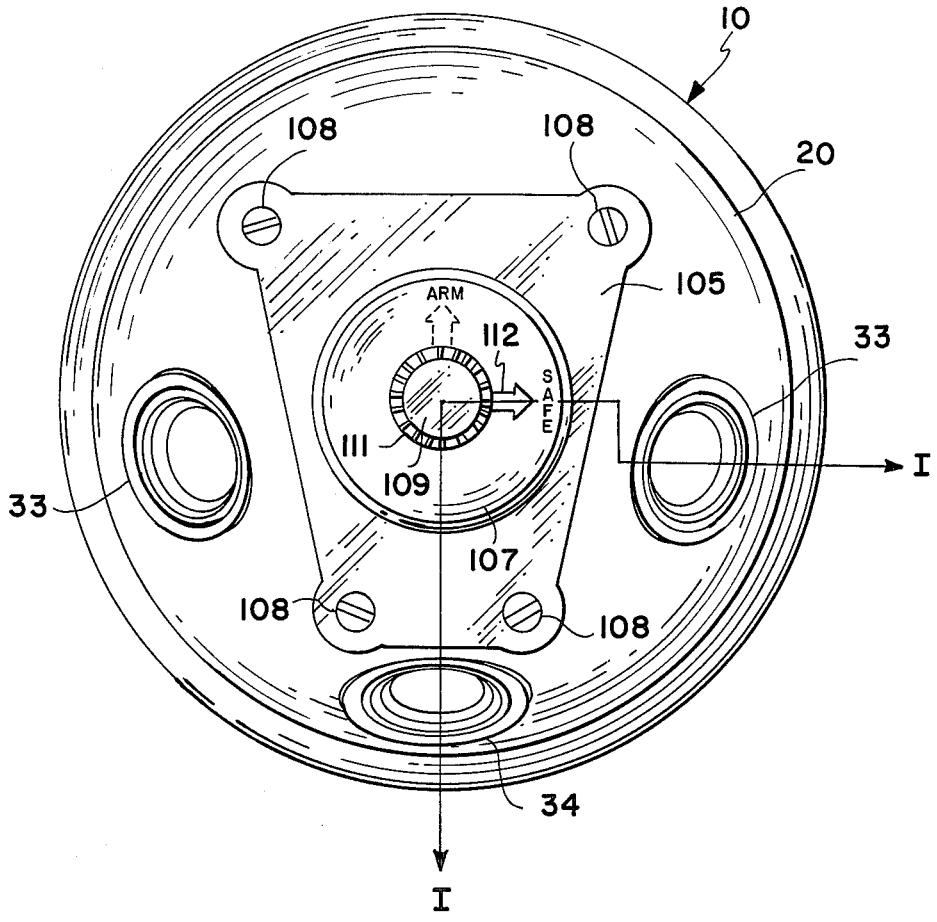
FIG. 6 is a plan view of the top of the igniter assembly of the present invention illustrating a manually operated safe-arm feature.

As shown in FIG. 6 the preferred embodiment described herein is adapted for two squibs but only one is included in this detailed description in the interest of clarity, it being understood that where more than one squib is employed that they are of identical construction.

A metal ring assembly 41 is molded and captured within the plastic wall of cap 20 during the molding process. During the post-cure process for molded cap 20 the shrinkage of the plastic material making up the cap 20 is such that it will separate slightly from metal ring 41 and thereafter permit relative movement between the cap 20 and metal ring 41. Suitable O-ring seals, provided between the relatively movable parts, prevent any gas leakage around or through the assembly when igniter assembly 10 is installed within a rocket motor casing.

Suitable threaded stainless steel inserts are molded within the top of cap 20 for the installation of suitable pressure monitoring devices therein. One such insert is shown in FIG. 1 and designated by reference numeral 34 with a pressure monitor **34*a* threadingly positioned therein. Suitable O-ring surfaces are molded at the base and top of insert 34 to provide for a double seal with O-rings 29 and 31 when pressure monitor 34*a* is secured therein. Insert 34 is similar to squib fitting 33 and although only two such fittings are shown in FIG. 1, obviously any number of pressure monitoring devices and electrically actuated squibs may be employed as so desired. Suitable threaded protective plugs are installed within these fittings during the molding process and are used until ready for loading of the igniter assembly. These protective plugs serve as a form for the O-ring sealing surfaces at each end of the inserts and are removed to permit drilling of the necessary ports (small arrows in FIG. 1 and reference numeral 51** in FIG. 2) through the molded plastics to provide communication of the inserts to the area desired. After drilling of the ports, the protective plugs or suitable plastics covers may be placed within the inserts until the pressure monitors and squibs are to be installed.

Ring assembly 41 is provided with an annular lip 43 which extends beyond the exterior circumference of closure cap 20. Annular lip 43 is provided with suitable grooves therein for insertion of conventional O-rings to assist in providing a gas-tight seal between the igniter assembly 10 and the rocket motor casing. Also provided on the exterior surface of ring assembly 41 is a threaded annular area designated by reference numeral 46 to serve as the primary attachment of igniter assembly 10 within a rocket motor casing.

Figure 2:
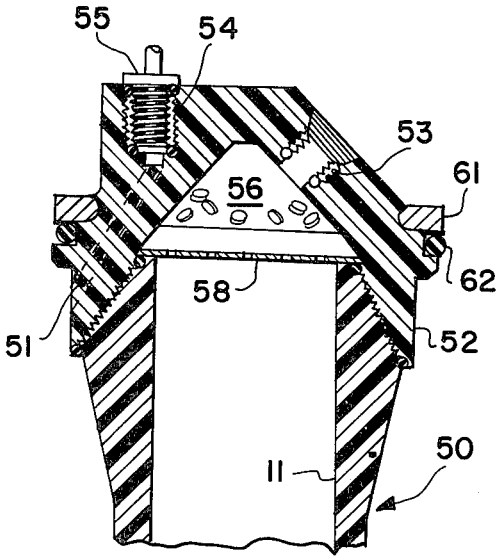
FIG. 2 is a part sectional view showing an alternate assembly of the lightweight pyrogen igniter assembly of the present invention.

Referring now more particularly to FIG. 2, the igniter assembly partially shown therein is designated generally by reference numeral 50 and includes an identical elongated tubular member 11 with the only differences being in the closure cap designated here by reference numeral 52. As shown therein, closure cap 52 contains the ignition pellet charge 56 within a cavity formed in the closure cap and retained therein by a pellet retainer plate or screen 58 in a like manner as in the previously described embodiment. The exteriorly disposed retainer ring 61 is molded and captured within the body of closure cap 52 as in the previously described embodiment. The primary difference being that retainer ring 61 is a load distribution ring against which a suitable snap ring (not shown) rests to retain igniter assembly 50 within the housing of a rocket motor case. In this embodiment, a suitable O-ring 62 would be disposed between retainer ring 61, closure cap 52 and the rocket motor casing to provide the gaseous seal required therebetween. Suitable stainless steel inserts designated by reference numerals 53 and 54 are also provided in closure cap 52 for retaining the electrically actuated squib or squibs (not shown) and suitable pressure monitoring devices therein. As in the previous embodiment mating O-ring sealing surfaces are molded within closure cap 52 for double sealing the squibs and pressure monitors therein. Pressure monitoring in this embodiment would be through monitor 55 disposed in insert 54 and would monitor the total motor pressure developed within the rocket motor case via channel 51. The pressure monitor 34*a* in FIG. 1, however, leads to the inside of the igniter assembly and monitors only the pressure within the igniter assembly. Thus, the direction of the passageway determines whether motor or igniter pressure is being measured by that particular monitor.

Figure 3:
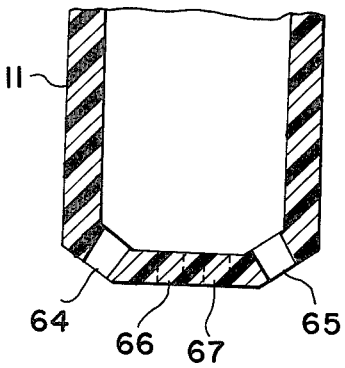
FIG. 3 is a part sectional view illustrating an alternate arrangement for the closed or nozzle end of the pyrogen igniter of the present invention.

Referring now more particularly to FIG. 3, a modified closed or nozzle end for elongated tube 11 is illustrated wherein tube 11 is provided with multiple nozzles or exit ports in the base thereof for expelling of the hot ignition gases from the igniter assembly into the solid propellant rocket motor casing. These ports are designated by reference numerals 64, 65, 66 and 67 herein, but obviously any number of such exit ports may be employed.

Figure 4:
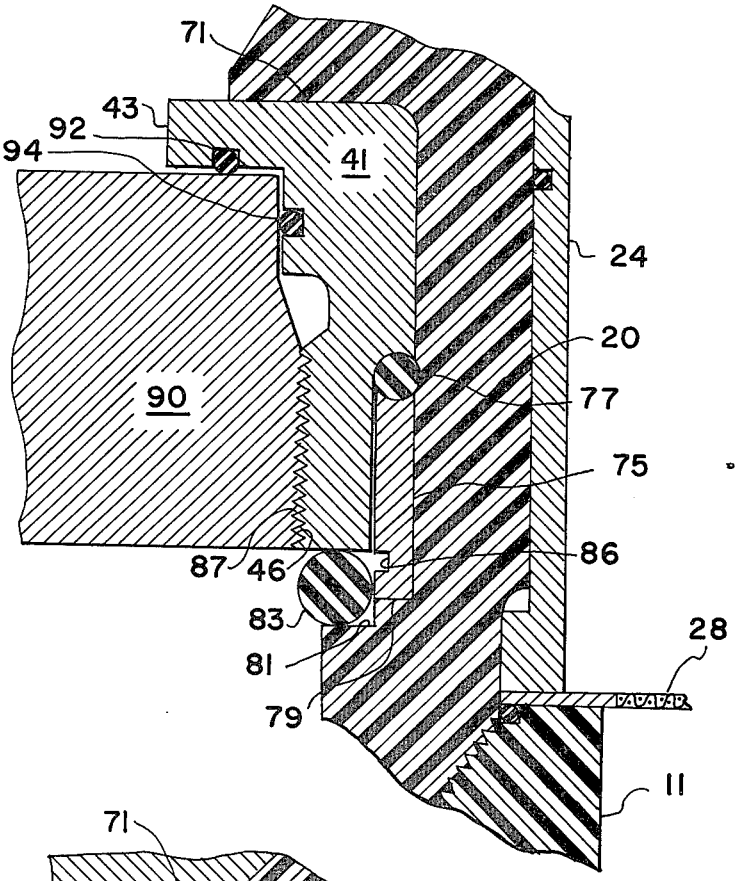
FIG. 4 is an enlarged part sectional view of the area shown by line IV—IV of FIG. 1 and illustrating this embodiment of the present invention as the igniter assembly would be installed within a rocket motor casing.

Referring now more particularly to FIG. 4, an enlarged view of the retainer ring assembly for closure cap 20 (as taken along line IV—IV of FIG. 1) is shown and designated by reference numeral 41. As shown therein, closure cap 20 is attached to elongated tube 11 and contains the ignition pellet cup 24 with pellet retainer 28 maintaining the ignition charge (not shown) therein. Retainer ring 41 is molded directly into cap 20 as will be further explained hereinafter. Retainer ring 41 includes a top surface having an annular lip segment 43 integrally extending beyond the annular recess 71 provided in the closure cap 20. The inner surface of retainer ring 41 extends downwardly at an angle of 90° from the top surface thereof and has a first portion engaging annular recess 71 and a stepped second portion horizontally spaced from the annular recess as shown in FIG. 4. The stepped portion of annular ring 41 terminates with a bottom surface parallel to the top surface thereof and vertically spaced from the bottom surface of the annular recess 71 formed in cap 20. A second annular metal ring 75 is disposed within the annular recess 71 of cap 20 with the ring 75 having a top surface short of the stepped portion of retainer ring 41 and a suitable O-ring seal 77 positioned therebetween. The bottom surface of annular ring 75 extends beyond the bottom surface of retainer ring 41 and engages the bottom of annular recess 71. An inner surface of annular ring 75 engages annular recess 71 and the outer surface of ring 75 engages the stepped portion of retainer ring 41 that is spaced from recess 71. As shown in FIG. 4, the bottom surface of annular recess 71 is provided with a stepped area to form an inner and outer or a two-step bottom surface with the inner step thereof being designated by reference numeral 79 and the outer step being designated by reference numeral 81. Thus, the bottom surface of annular ring 75 engages step 79. An O-ring seal 83 engages step 81 and the bottom surface of retainer ring 41.

A circumferential groove 86 is provided in the exterior surface area of annular ring 75 and is of a substantial one-half thickness thereof. As shown in the drawing, groove 86 is provided in ring 75 in the area immediately adjacent that portion thereof that extends beyond retainer ring 41 and is disposed adjacent O-ring 83. It is thus readily seen that upon deformation of O-ring 83 the deformed surface thereof would tend to flow into the annular or circumferentially disposed groove 86 to provide a gaseous seal between annular ring 75 and retainer ring 41 as well as to insure a seal between annular ring 75 and cap 20 along step 79 thereof. Any gases escaping O-ring 83 would be prevented from further movement by O-ring seal 77 which would be deformed by pressure exerted thereon by annular ring 75. A portion of retainer ring 41 is provided with a threaded area as designated by reference numeral 46 with this threaded area serving to engage mating threads 87 formed on the interior surface of a rocket motor casing 90, in a conventional manner. A double O-ring seal arrangement is provided by O-ring seals 92 and 94 positioned in suitable recesses (not designated) formed in retainer ring 41. This redundant O-ring seal pair serves to insure, along with O-ring seals 77 and 83, that there is no gas leakage from within the rocket motor casing 90 to the exterior thereof when the igniter assembly 10 initiates the rocket propellant charge contained within motor casing 90.

Figure 5:
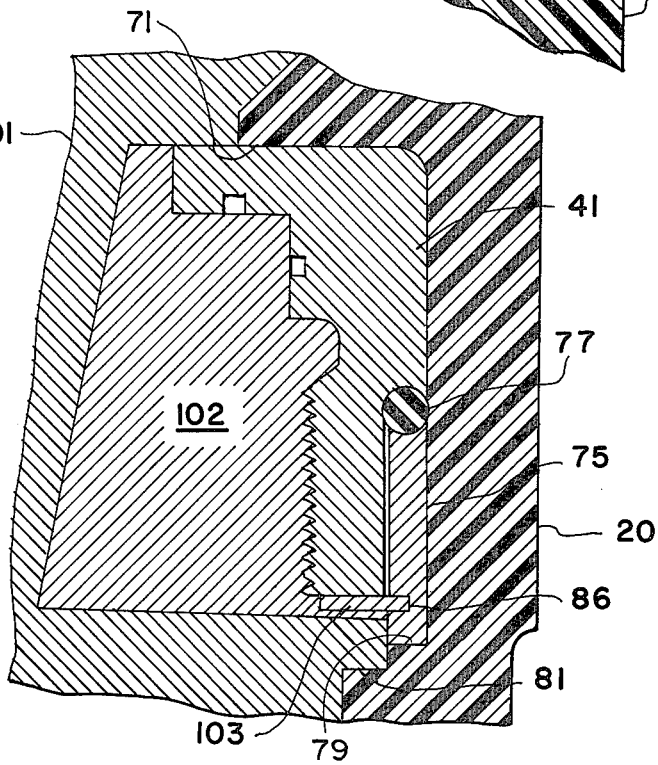
FIG. 5 is an enlarged part sectional view illustrating how the assembly of FIG. 4 would be molded.

Referring now more particularly to FIG. 5 the molding process for forming a closure cap 20 shown in FIG. 4 will be briefly described. The thermosetting plastics materials suitable for use in the present process as well as the specific process for molding the spiral buttress threads on adjacent rocket component parts are disclosed in U.S. Pat. No. 3,780,151. This process will not be further elaborated on herein other than to explain that in the post-curing process, as described in the reference patent, that the retainer ring 41 of the present invention will be captured by the molded plastics but will be relatively rotatable therewith. Retainer ring 41 and the plastic cap 20 have sufficiently different thermal coefficients of expansion that during the post-cure operation of the molded plastics, the plastics material will shrink sufficiently away from the metal retainer ring 41 and annular ring 75 to permit relative rotative movement between the metal and plastic parts. This relative movement is desirable to assist in alining the igniter assembly 10 within a rocket motor casing 90 such that the safe-arm indicators for the safe-arm assembly and consequently the position of rotor 30 would be visible to an operator at the same relative station at all times regardless of motor casing 90 orientation. During molding, ring 41 is maintained in position within mold 101 by multiple arcuate cavity split inserts, one of which is shown and designated by reference numeral 102. A multi-segment metal ring 103 is maintained within annular groove 86 on ring 75 by split inserts 102 during the molding process. Inserts 102 are formed of suitable heat conductive materials to facilitate transfer of heat to the mold cavity during molding and curing of the plastics components.

Referring now more particularly to FIG. 6, the importance of the relative rotating movement between the retainer ring 41 and closure cap 20 will be more specifically explained. As shown therein, cap 20 is provided with a suitable safe-arm assembly mounting surface 105 with an indicator surface 107 thereon. Safe-arm assembly 105 is attached by suitable screws or the like, designated by reference numeral 108, to secure cover plate 105 to closure cap 20. Safe-arm rotor 30 is provided with an extension that extends through closure cap 20 and terminates in a tip portion on which is secured a knob 109 which is provided with a knurled exterior surface 111 thereon. An indicator arrow 112 is integrally secured to the knob 109 on rotor 30 and is movable from the safe position shown in solid line to the armed position (shown by dotted line) at the upper portion or 12 o'clock position on cover plate 105. Thus, by providing the relative rotative movement between cap 20 and retainer ring 41 the igniter assembly 10 may always be positioned within a rocket motor casing in such position that a quick glance to locate the position of the safe-arm arrow 112 (either at the 12 o'clock or the 3 o'clock position) will give an immediate indication as to whether the rocket motor is in the armed or safe position. This certainty of safe and arm location minimizes the possibility of inadvertent ignition of the igniter assembly until desired.

One of the primary causes of accidental ignition of explosive devices including, but not limited to, rocket motors is the discharge of static electricity. To bleed off static electrical charges as they may be accumulated on the igniter assembly of the present invention, a graphite fiber is compounded into the molded material during the molding process with a three-to-five percent by weight of graphite being employed in the total molding composition which prevents a safety hazard without affecting the strength of the molding parts. Also, the final molded parts can be spray-painted with a conductive epoxy paint to achieve the same bleed-off results, if so desired.

Thus, it is readily seen that the present invention provides a standardized composite pyrogen igniter assembly that requires very few steps for manufacture and large number of identical parts can be made simply and expeditiously. The standardized molded pyrogen igniter, thus formed, provides a gas-seal between the various parts while permitting relative rotation of the retainer ring on the remaining igniter assembly. This involves molding an elastomeric seal directly into the part where the cap is molded as explained hereinbefore with shrinkage of the composite material during the curing, freeing the retainer ring for relative rotation. The elastomeric O-ring materials employed possess "memory" and maintains the seal between the metal retainer ring 41 and the molded plastic cap 20. The molding compound from which cap 20 and tube 11 are fabricated provides all the required structural and thermal properties needed and therefore eliminates the need for any additional insulation as is required in the prior art metal igniter assemblies. These prior art or present day pyrogen igniters employ pyrotechnic trains of ignition materials that are readily adaptable for use in the present invention and thereby insure an identical ballistic performance of this invention and that of the presently manually machined igniters.

The composite molded standard pyrogen igniter of the present invention will replace the inert portions of the presently used pyrogen igniters while duplicating the structural, thermal and ballistic functions thereof at a lower cost and weight and with increased simplicity and reliability.

To fabricate a standard molded pyrogen assembly, using standardized mold cavities and processes, it is a simple matter to select the related mold tooling and, when molding the cap, set in place the desired threaded inserts and other mold components, fill the mold with a predetermined quantity of molding compound, close the mold, apply the recommended pressure and temperature for fill-out and cure, relieve the pressure, cool the tooling, and eject the molded part from the cavity for the post-cure process step. The elongated tube 11 is made as in process disclosed in above-referenced patent. The only additional machining required in the present invention is to drill through the remaining molded plastics in the port and nozzle exits before the parts can be used.

Basically, three inert parts in the molded pyrogen assembly replace up to fourteen different parts in the prior art conventional rocket igniter design. Pressure measurements may be made either inside the pyrogen igniter (FIG. 1) or in the rocket motor cases (FIG. 2) and such measurements are possible with proper location of the drilled passages formed through the cover of closure cap 20. After post-curing the molded elongated tube is sand-blasted to improve propellant grain bonding and the propellant can be cast directly against the tube inside diameter without any intermediate bonding material, or in lieu thereof, a propellant cartridge can be installed and bonded in place within the elongated tube. The safe-arm rotor 30 with shaft 37 and ignition charge cup 24 are installed within closure cap 20. After loading the ignition charge 26 in cup 24 (FIG. 1), or charge 56 in cap 50 (FIG. 2) the completed tube assembly is then torqued into cap 20 (or 50, FIG. 2) after installation of the proper O-rings and application of a conventional bonding epoxy or the like material to the molded thread surface. The molded igniter assembly is then installed into the rocket motor case and held in place by either the snap ring retainer (FIG. 2) or the threaded joint as in the other embodiments. The protective plugs are then removed from squib fitting 33 and pressure monitor insert 34, and others, if desired and the proper initiators with their conventional O-rings are threadedly secured within these inserts. The pressure pickup plugs with their O-rings are installed and the igniter is then ready for firing. Care is exerted throughout this assembly process, with regard to the embodiments employing the safe-arm rotor, to insure that the rotor is in the safe position wherein the passageway and ports separating the ignition charge within ignition pellet cup 24 and the electrically actuated squib is interrupted. Once the rotor is turned to the armed position, the igniter is then ready for firing.

To inspect the molded parts during manufacture thereof, they may be weighed, dimensionally inspected and x-rayed as necessary. Since they are identically processed, it is sufficient to weigh the parts and only dimensionally inspect a representative sample. The closure caps and tubes are assembled without a bonding agent and hydrostatically tested to a proof pressure level prior to loading thereof with the pyrotechnics. A representative comparison of some present-day igniter assemblies is compared with the molded composite pyrogen igniter assemblies prepared according to the present invention in the following table.

TABLE I

COMPARISON OF PRESENTLY USED IGNITERS VS THE MOLDED COMPOSITE PYROGEN IGNITERS OF THE INSTANT INVENTION

| | Algol III | Castor II-A | Antares | Altair III | TE-364 | Astrobee "F" |
|---|---|---|---|---|---|---|
| Present Inert Weight lb. | 12.40 | 10.60 | 6.93 | 1.80 | 3.95 | 4.37 |
| Molded Inert Weight, lb. | 4.16 | 4.43 | 5.83 | 1.51 | 2.45 | 1.83 |
| Weight Saved lb. | 8.24 | 6.17 | 1.10 | .29 | 1.50 | 2.54 |
| Cost to Govn'mt of Present Inert Compnents $ ea. | 720. | 660. | 3,000 | 350. | 3,200 | 445. |
| Cost to Govn'mt of Molded Components $ ea.(est) | 100. | 102. | 96. | 86. | 99. | 88. |
| Number of Uses Planned (5Yrs) | 48 | 765 | 48 | 48 | 125 | 48 |

The cost columns in the above table include the costs of assembling and inspecting the igniters.

It is thus seen that the present invention provides a savings in weight, cost, time and effort in each of the above specific categories.

Although the invention has been described relative to specific embodiments thereof, no exact dimensions are given herein and no specific quantities of the pyrogen charge or the ignition pellet charge has been given inasmuch as these would vary slightly with each different size rocket motor employed. For example, the external diameter and configuration of the closure cap can be changed to exactly match mating surface of existing motor cases. Also, the number and configuration of the squib and pressure ports can be changed as readily desired. The length of elongated tube 11 can also be shorted or lengthened as well as changed in diameter without departing from the present invention. Additionally, the number, location and configuration of the nozzle or exit ports can be maintained and changed as desired in a specific ignition system for a particular solid propellant rocket. The various O-rings employed may be any of conventional composition such as silicon, buna and viton rubber and the like, that is compatible with the uses intended herein. Also, when it is desired to improve the relative rotative movement between the retainer ring and the molded plastics, the parts may be provided with a suitable bonded film lubricant such for example as Dow Corning's Molykote 100 or Acheson Colloids Company's Enralon 310, or the like.

Thus, although the invention has been described relative to specific embodiments thereof, there are obviously numerous variations and modifications readily apparent to those skilled in the art in the light of the above teachings. It is therefore to be understood that the invention described herein may be practiced otherwise than as specifically described and is limited only by the following claims.

What is claimed as new and desired to be secured by Letters Patent of the United States is:

1. A standardized lightweight pyrogen assembly for rocket motors comprising:

a molded plastics elongated tube containing the pyrogen charge and adapted to be inserted in a rocket motor case for ignition of the rocket motor charge, said elongated tube being open at one end and having at least one passageway at the other end thereof for expelling ignition gases into the rocket motor, a molded plastics cap closing the open end of said elongated tube and serving as a closure for the rocket motor case, said elongated tube being provided with external spiral buttress threads on the open end and said cap being provided with internal spiral buttress threads for attachment to said elongated tube, said cap containing an ignition pellet cup and pellet retention means serving to close the open end of said cup for retaining an ignition charge therein, the other end of said cup being provided with a passageway to permit entrance of ignition gases to the interior of said cup, a safe-arm rotor disposed within said cap, said safe-arm rotor being provided with a bore therethrough, and rotatable from an armed position wherein said rotor alines the bore with the passageway in said cup and a safe position wherein a portion of said rotor blocks the passageway in said cup, a squib retained within said cap in a port that communicates with said rotor bore when said rotor is in said armed position, attachment means circumscribing the exterior surface of said closure cap, and said attachment means being secured to said cap so as to provide relative rotative movement therebetween and serving to sealingly attach the igniter assembly within the rocket motor casing.

2. The igniter assembly of claim 1 wherein said attachment means includes:

(1) a first annular metal ring disposed within an annular recess circumscribing said closure cap, said first annular ring including, (a) a top surface having an annular lip extending beyond the annular recess in said closure cap, (b) an inner surface having a first portion extending 90° from said top surface and having a first portion engaging said annular recess in said closure cap and a stepped second portion horizontally spaced from the annular recess, (c) said stepped portion terminating with a bottom surface parallel with said top surface and vertically spaced from said annular recess, and (2) a second annular metal ring disposed within the annular recess of said closure cap, said second ring having a top and bottom surface and an inner and outer surface and positioned with the outer surface thereof engaging the stepped portion of said first annular metal ring and the inner surface thereof engaging said annular recess in said closure cap, an O-ring seal separating the top surface of said second annular ring and said first annular ring and, the bottom surface of said second annular ring extending beyond said first annular ring so as to engage the bottom of said annular recess.

3. The igniter assembly of claim 2 wherein said annular recess in said closure cap is provided with a stepped bottom surface to form an inner and an outer or two-step bottom surface and said second annular ring is substantially of the same thickness as each of said steps and engages the span of the innermost of said steps.

4. The igniter assembly of claim 3 including an O-ring seal engaging the outer step of said bottom surface, the bottom of said first annular ring and the exterior portion of said second annular ring that extends beyond said first annular ring.

5. The igniter assembly of claim 4 wherein the exterior portion of said second annular ring that extends beyond said first annular ring is provided with a circumferential groove in the exterior surface thereof.

6. The igniter assembly of claim 2 wherein at least a portion of the exterior surface of said first annular ring is provided with external threads for attachment of said igniter assembly within a rocket motor casing and a first O-ring seal being provided in an annular groove on the exterior surface of said first annular ring and a second O-ring seal provided in an annular groove on the bottom surface of said annular lip of said first annular ring, said first and second O-ring seals serving to sealingly engage portions of the rocket motor casing when said igniter assembly is threaded into the rocket motor casing.

7. A lightweight pyrogen igniter assembly comprising:

an elongated molded plastics tube adapted to contain a pyrogen charge and to be inserted into a rocket motor case for ignition of the rocket motor charge, said elongated tube having an open end and a closed end with said closed end being provided with at least one exit port therethrough for expulsion of ignition gases from said tube, said open end of said elongated tube being provided with a tapered exterior surface having spiral buttress threads formed along the length thereof, a molded plastics closure cap for said open end of said elongated tube, said closure cap being provided with a tapered interior surface and having mating spiral buttress threads molded therein for securing said cap to said elongated tube, retainer means disposed between said cap and said elongated tube, when secured, for retaining an ignition charge within said cap, means formed within said cap for securing an ignition squib therein in communication with the interior of said cap and for igniting the ignition charge in said cap, means secured to the exterior circumference of said cap for sealingly attaching the igniter assembly within a rocket motor casing, said means secured to the exterior circumference of said cap for sealingly attaching the igniter assembly within a rocket motor casing including an externally threaded annular metal ring disposed within a circumferential groove around said closure cap and adapted to engage a threaded recess within a rocket motor casing, and said metal ring being relatively rotatable with respect to said cap.

8. The lightweight pyrogen igniter of claim 7 including a threaded insert positioned within said closure cap and a bore extending therefrom to the interior of said cap and pressure monitoring means disposed in said threaded insert for monitoring the gaseous pressure generated within said igniter upon ignition thereof.

9. The lightweight pyrogen igniter of claim 7 including said elongated molded plastics tube being provided with a shoulder surface at the open end thereof adjacent said spiral buttress threads, an ignition pellet cup disposed within said closure cap for containing an ignition pellet charge and wherein said retainer means for retaining the ignition charge within said cap closes said ignition pellet cup and rests on said shoulder surface of said elongated tube.

10. The lightweight pyrogen igniter of claim 9 wherein said retainer means is a non-corrosive metal screen.

11. A method of providing a gastight seal between two parts utilized to separate two areas of different gas pressures while maintaining relative rotative movement between the two parts comprising:

providing a first part in the form of a rocket motor casing and adapted to withstand high gaseous pressures therein, providing at least one threaded opening in a wall of the first part, molding a plastics second part to serve as the closure for said first part, capturing an annular metal ring assembly within an annular groove formed on the exterior of the plastics closure during the molding thereof, providing a gastight seal between the captured annular metal ring and the molded plastics second part, providing external threads on the exterior of the annular ring assembly to engage the threaded opening in the first part, providing double O-ring seals in the abutting areas formed between the first and second part when they are threadedly connected, securing a rocket igniter within the rocket motor casing as an integral portion of the second part, and wherein the molded plastics and the metal ring assembly have inherent diverse thermal coefficients of expansion and during the molding process the metal ring will be captured within the plastics and during the normal post curing of the plastics the metal and plastics will separate sufficiently to permit relative rotative movement therebetween but will retain the gastight sealed relation between the rotative and stationary parts.

12. The method of claim 11 including providing safe-arm indicia on the plastics closure second part and rotating the second part relative to the first part to selectively position the safe-arm indicia.

* * * * *